US005194357A

United States Patent [19]

Hodgson

[11] Patent Number: 5,194,357

[45] Date of Patent: Mar. 16, 1993

[54] DEVELOPER COMPOSITIONS WITH CARRIER PARTICLES COMPRISING POLYMERIC ALCOHOL WAXES

[75] Inventor: Richard J. Hodgson, Rochester, N.Y.

[73] Assignee: Xerox Corporation, Stamford, Conn.

[21] Appl. No.: 753,249

[22] Filed: Aug. 30, 1991

[51] Int. Cl.[5] ..... G03G 9/113

[52] U.S. Cl. ..... 430/108; 430/109; 430/110; 430/106

[58] Field of Search ..... 430/108, 109, 110, 106

[56] References Cited

U.S. PATENT DOCUMENTS

| | | | |
|---|---|---|---|
| 3,655,374 | 4/1972 | Palermiti et al. | 96/1.4 |
| 3,857,792 | 12/1974 | Madrid et al. | 252/62.1 |
| 3,983,045 | 9/1976 | Jugle et al. | 252/62.1 P |
| 4,078,926 | 3/1978 | Gibson et al. | 96/1 SD |
| 4,367,275 | 1/1983 | Aoki et al. | 430/99 |
| 4,556,624 | 12/1985 | Gruber et al. | 430/110 |
| 4,859,550 | 8/1989 | Gruber et al. | 430/39 |
| 4,861,694 | 8/1989 | Aoki et al. | 430/137 |
| 4,883,736 | 11/1989 | Hoffend et al. | 430/110 |
| 4,921,771 | 5/1990 | Tomono et al. | 430/110 |
| 4,935,326 | 6/1990 | Creatura et al. | 430/108 |
| 4,937,166 | 6/1990 | Creatura et al. | 430/108 |
| 4,952,477 | 8/1990 | Fuller et al. | 430/109 |
| 5,032,482 | 7/1991 | Kinoshita et al. | 430/102 |
| 5,085,963 | 2/1992 | Suzuki et al. | 430/106.6 |

FOREIGN PATENT DOCUMENTS 1442835 11/1989 United Kingdom .

*Primary Examiner*—Marion E. McCamish
*Assistant Examiner*—Rosemary Ashton
*Attorney, Agent, or Firm*—E. O. Palazzo

[57] ABSTRACT

A developer comprised of a toner composition comprised of resin particles and pigment particles, and carrier particles comprised of a core with a coating comprised of a wax component, or a polymeric alcohol of the formula $$CH_3(CH_2)_nCH_2OH$$

wherein n is a number of from about 30 to about 300.

20 Claims, No Drawings

DEVELOPER COMPOSITIONS WITH CARRIER PARTICLES COMPRISING POLYMERIC ALCOHOL WAXES

BACKGROUND OF THE INVENTION

This invention is generally directed to toner and developer compositions, and more specifically the present invention is directed to toner compositions, including magnetic, single component, and colored toner compositions, and wherein the carrier particles are coated with a low molecular weight wax, such as CERELUBE S363 TM, available from Diamond Shamrock, or with certain polymeric alcohol waxes. In one embodiment of the present invention, the developer is comprised of a toner composition comprised of resin particles, and pigment particles, and carrier particles having present on the surface a low molecular weight wax, such as CERELUBE S363 TM, available from Diamond Shamrock, or certain polymeric alcohol waxes with hydroxyl functionality. There is also provided in accordance with the present invention developers comprised of positively charged toner compositions comprised of resin particles, pigment particles, and charge enhancing additives, and carrier particles with coatings of certain waxes. Furthermore, in another embodiment of the present invention there are provided single component toner compositions comprised of resin particles, and magnetic components such as magnetites. The toner and developer compositions of the present invention are useful in electrostatographic imaging systems, especially those systems wherein blade cleaning of the photoconductive member is accomplished. Moreover, the toner and developer compositions of the present invention enable the photoconductive imaging member present in an imaging apparatus to function for extended time periods, for example, up to 125,000 cycles while eliminating, or minimizing filming of the imaging member.

Developer and toner compositions with certain waxes therein are known. For example, there are illustrated in U.K. Patent Publication 1,442,835, the disclosure of which is totally incorporated herein by reference, toner compositions containing resin particles, and polyalkylene compounds, such as polyethylene and polypropylene of a molecular weight of from about 1,500 to about 20,000 and preferably about 6,000, reference page 3, lines 97 to 119, which compositions prevent toner offsetting in electrostatic imaging processes. The aforementioned waxes may be selected as carrier coatings for the developers of the present invention in embodiments. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates such as papers wherein there is selected toner compositions containing specific external lubricants including various waxes, see column 5, lines 32 to 45, which waxes are substantially different in their properties and characteristics than the polymeric alcohols selected for the toner and developer compositions of the present invention; and moreover, the toner compositions of the present invention with the aforementioned polymeric alcohol additives possess advantages such as elimination of toner spotting not achievable with the toner and developer compositions of the '275 patent.

Moreover, toner and developer compositions containing charge enhancing additives, especially additives which impart a positive charge to the toner resin, are well know. Thus, for example, there is described in U.S. Pat. No. 3,893,935 the use of certain quaternary ammonium salts as charge control agents for electrostatic toner compositions. There are also described in U.S. Pat. No. 2,986,521 reversal developer compositions comprised of toner resin particles coated with finely divided colloidal silica. Further, there are illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride. Other prior art disclosing positively charged toner compositions with charge enhancing additives include U.S. Pat. Nos. 3,944,493; 4,007,293; 4,079,014 and 4,394,430.

SUMMARY OF THE INVENTION

It is an object of the present invention to provide toner and developer compositions which possess many of the advantages illustrated herein.

Another object of the present invention resides in the provision of toner and developer compositions with stable triboelectrical characteristics for extended time periods.

In another object of the present invention there are provided conductive developer compositions and wherein photoreceptor filming is substantially eliminated, or minimized.

In another object of the present invention there are provided positively, or negatively charged toner compositions with carrier particles containing certain waxes therein or thereon which are useful for causing the development of electrostatic latent images, including color images.

In yet another object of the present invention there are provided processes for reducing photoreceptor filming, and wherein the use of metal salts of fatty acids, such as zinc stearate are avoided, which stearate causes undesirable photoreceptor filming.

A number of advantages are associated with the present invention, such as the conductivity of the developer is increased from, for example, $7.6\times10^{-12}$ ohm/cm$^2$ to $3.1\times10^{-9}$ ohm/cm$^2$ by the addition of the wax coating to the surface of the carrier particles and the triboelectric charging capacity of the carrier particles is enhanced by the addition of the wax coating to the carrier particles. Enhancement, for example, in embodiments is up to twice the amount of the normal triboelectic value of 10 to 20 microcolumbs per gram; for example the triboelectic properties of a steel carrier core with 0.02 weight percent of zinc stearate coating was −12, with 0.02 weight percent of CERELUBE TM was −20, and with 0.04 weight percent of a polymeric hydroxy wax of Example I was −25 and with no polymeric hydroxy wax of Example I was −15.

These and other objects of the present invention are accomplished by providing developer compositions with toner compositions comprised of resin particles, pigment particles, and optional additives, such as charge additives. More specifically, the present invention in embodiments is directed to developer compositions comprised of toner compositions comprised of resin particles, pigment particles inclusive of magnetites, and charge additives, such as negative charge enhancing additives, like TRH, or ammonium bis[1-(3,5-dinitro-2-hydroxyphenyl)azo-3-(N-phenylcarbamyl)-2-napthalenolate] chromate, reference U.S. Pat. No. 4,433,040, the disclosure of which is totally incorporated herein by reference, and carrier particles that contain a coating of certain waxes as illustrated herein. Processes for reducing photoreceptor filming with the the developers of the present invention are also encompassed within the scope of the present invention. In one embodiment of the present invention there are provided developers comprised of carrier particles with a wax coating, or certain polymeric alcohol waxes, which waxes are available from Petrolite Corporation.

In addition, in accordance with embodiments of the present invention there are provided developer compositions comprised of toner compositions containing resin particles, particularly styrene butadiene resins, pigment particles such as magnetites, carbon blacks or mixtures thereof; and optional charge enhancing additives, particularly for example known negative additives such as TRH, and known positive additives such as distearyl dimethyl ammonium methyl sulfate, reference U.S. Pat. No. 4,560,635, the disclosure of which is totally incorporated herein by reference, and carrier particles with a wax coating. As carrier core components for the aforementioned compositions, there can be selected steel, iron, or ferrite materials, particularly with a polymeric coating thereover, and a wax thereon.

Illustrative examples of suitable toner resins selected for the toner and developer compositions of the present invention, and present in various effective amounts such as, for example, from about 70 percent by weight to about 95 percent by weight, include polyesters, polyamides, epoxy resins, polyurethanes, polyolefins, vinyl resins and polymeric esterification products of a dicarboxylic acid and a diol comprising a diphenol, styrene acrylates, styrene methacrylates, and styrene butadienes. Various known suitable vinyl resins may be selected as the toner resin including homopolymers or copolymers of two or more vinyl monomers. Examples of vinyl monomer units include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; and the like. Specific resins include styrene butadiene copolymers, especially styrene butadiene copolymers prepared by a suspension polymerization process reference, U.S. Pat. No. 4,558,108, the disclosure of which is totally incorporated herein by reference; and mixtures thereof.

As one toner resin there can be selected the esterification products of a dicarboxylic acid and a diol comprising a diphenol, which components are illustrated in U.S. Pat. No. 3,590,000, the disclosure of which is totally incorporated herein by reference. Other toner resins included styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as Pliolites® from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol.

Numerous well known suitable pigments can be selected as the colorant for the toner particles including, for example, carbon black, such as REGAL 330®, nigrosine dye, aniline blue, phthalocyanine derivatives, magnetites and mixtures thereof. Generally, the pigment particles are present in various effective amounts of from, for example, about 3 percent by weight to about 20 percent by weight, and preferably from about 3 to about 10 weight percent based on the total weight of the toner composition.

When the pigment particles are comprised of magnetites, including those commercially available as Mapico Black®, they are present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black.

Also embraced within the scope of the present invention are colored toner compositions containing as pigments or colorants magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethylsubstituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. These pigments are generally present in the toner composition in an amount of from about 2 weight percent to about 15 weight percent based on the weight of the toner resin particles.

Illustrative examples of optional charge enhancing additives present in various effective amounts, such as for example from about 0.1 to about 20 percent by weight, include TRH, alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives.

With further respect to the developer compositions of the present invention, an important component present therein that enables many of the advantages illustrated herein to be obtained is the wax coatings, or linear polymeric alcohol coatings comprised of a fully saturated hydrocarbon backbone with at least about 80 percent of the polymeric chains terminated at one chain end with a hydroxyl group, which alcohol is represented by the following formula, reference U.S. Pat. No. 4,883,736, the disclosure of which is totally incorporated herein by reference:

$$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in an embodiment of the present invention the polymeric alcohols selected have a number average molecular weight as determined by gas chromatography of from about greater than 450 to about 1,400, and preferably of from about 475 to about 750.

The CERELUBE TM, such as CERELUBE S-363 TM, available from Diamond Shamrock as a 5 micron size polypropylene copolymer, coating was applied in the following manner: from between about 0.0 to 0.06 percent by weight was mechanically blended with the carrier using a roll mill. The blend was subsequently heated to 130° C., and cooled prior to adding toner. Unilin 700®, U.S. Pat. No. 4,883,736, and zinc stearate were applied in a similar manner. Conductivity of the developer was measured using a conductivity cell comprising a magnetic brush (Gutman Cell) at 10 volts and ranged from $8\times10^{-11}$ ohms/cm$^2$ at 0 percent CERELUBE® to $3\times10^{-9}$ ohms/cm$^2$ at 0.03 percent CERELUBE®. The function of the wax was to increase the bulk density of the developer so that the conductive carrier particles were closer together during the measurement on the magnetic brush.

Illustrative examples of carrier particles that can be selected for mixing with the toner compositions of the present invention include those particles that are capable of triboelectrically obtaining a charge of opposite polarity to that of the toner particles. Accordingly, the carrier particles of the present invention can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include granular zircon, granular silicon, glass, steel, nickel, iron, ferrites, silicon dioxide, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover, several of which are illustrated, for example, in U.S. Ser. No. 751,922 (now abandoned) relating to developer compositions with certain carrier particles, the disclosure of which is totally incorporated herein by reference. More specifically, there are illustrated in the aforementioned abandoned patent application carrier particles comprised of a core with a coating thereover of vinyl polymers, or vinyl homopolymers. Examples of specific carriers illustrated in the copending application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers components comprised of a core with a polymer coating mixture thereover, reference U.S. Pat. Nos. 4,937,166 and 4,935,326, the disclosures of which are totally incorporated herein by reference. More specifically, there are illustrated in these patents carrier particles prepared by a process which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000, and preferably from about 50 to about 275 microns, thus allowing these particles to possess sufficient density and inertia to avoid adherence to the electrostatic images during the development process. The carrier particles can be mixed with the toner particles in various suitable combinations, such as for example from about 1 to about 5 parts per toner to about 100 parts to about 200 parts by weight of carrier with the wax coating.

The toner compositions of the present invention can be prepared by a number of known methods, including mechanical blending and melt blending the toner resin particles, pigment particles or colorants, and additives followed by mechanical attrition. Other methods include those well known in the art such as spray drying, mechanical dispersion, melt dispersion, dispersion polymerization, extrusion, and suspension polymerization. The toner particles can be subjected to classification to provide a toner particle with an average volume diameter of from about 10 to about 25 microns.

The toner and developer compositions of the present invention may be selected for use in developing images in electrostatographic imaging systems containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines, while examples of charge transport layers include the aryl amines as disclosed in U.S. Pat. No. 4,265,990.

Moreover, the toner and developer compositions of the present invention are particularly useful with electrostatographic imaging apparatuses wherein blade cleaning is selected. Also, the developers of the present invention can be selected for imaging systems containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the present of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating magnetic carrier particles, means for causing the flexible imaging means to move at a speed of from about 5 centimeters/second to about 50 centimeters/second, means for causing the transporting means to move at a speed of from about 6 centimeters/second to about 100 centimeters/second, the means for imaging and the means for transporting moving at different speeds; and the means for imaging and the means for transporting having a distance therebetween of from about 0.05 millimeter to about 1.5 millimeters.

The following Examples are provided.

EXAMPLE I

A Hoeganaes steel core was coated with 0.02 percent and 0.04 percent by weight of a polymeric hydroxy wax, UNILIN ®, with a molecular weight of 700, as obtained from Petrolite Corporation, by dry blending the wax with the carrier in a roll mill and heating the blended carrier to 130° C. After cooling to room temperature, about 25° C., the conductivity of the coated carrier was measured at 10 volts using the conductivity cell indicated herein. The carrier conductivity ranged from 1.7E-8 to 3.2E-8 ohms/cm$^2$.

The carrier was then toned with 1 percent by weight of Toner B-5476 (a Banbury rubber mill blend of 68 weight percent of styrene-n-butylmethacrylate containing about 5 weight percent of VISCOL 550P TM propylene wax obtained from Sanyo Chemicals of Japan, 23 weight percent of a divinylbenzene crosslinked styrene n-butylmethacrylate, 8 weight percent of BLACK PEARLS 1300 TM carbon black, and 1 weight percent of TRH; and on the surface 0.3 weight percent of AEROSIL R972 ®). This developer was then agitated for 10 minutes in a paint shaker to cause a triboelectric charge to develop in the mixture. Carrier conductivity was then measured to be with 0.02 percent and 0.04 percent of the above UNILIN ® polymeric hydroxy compound:

0.0 percent-$2.8\times10^{-10}$
0.02 percent-$9.7\times10^{-9}$
0.04 percent-$1.2\times10^{-8}$ The above toner was then added to bring the concentration to 3 percent and the paint shaking was repeated. Triboelectric charge (Faraday Cage) and conductivity in a cell with two electrodes were measured on the developers.

| UNILIN ® Percent | Tribo Microcoulombs/ gram | Conductivity Ohms/cm |
|---|---|---|
| 0 | −14.6 | $7.6\times10^{-12}$ |
| 0.02 | −28.7 | $8.8\times10^{-10}$ |
| 0.04 | −24.6 | $3.1\times10^{-9}$ |

Thus, the UNILIN ® enhanced the tribo as well as increased the conductivity of the developer. An additional advantage is the decrease in the slope of the delta conductivity/delta toner concentration known as alpha. Thus, more toner can be added to the carrier without a loss in conductivity using the UNILIN ® than can be added without the UNILIN ®.

EXAMPLE II

PK 4008-008 a Hoeganaes core solution coated with 1 weight percent of (polymethylmethacrylate) PMMA, and 20 weight percent of BLACK PEARLS 1300 TM carbon black was coated with 0.01 percent and 0.02 percent of CERELUBE S-363 ® as in Example I. Conductivity, which was measured at 10 volts, ranged from $1.1\times10^{-6}$ to $1.5\times10^{-6}$. Toner B-5476 was added at 3 percent by weight to the carrier.

After 15 minutes agitation in a paint shaker, tribo and conductivity were measured as in Example I.

| UNILIN ® Percent | Tribo Microcoulombs/ gram | Conductivity Ohms/cm |
|---|---|---|
| 0 | −6.7 | $7.0\times10^{-10}$ |
| 0.01 | −8.8 | $2.5\times10^{-8}$ |
| 0.02 | −4.7 | $7.8\times10^{-8}$ |

Although the tribo enhancement was not as pronounced as in Example I, the effect on conductivity was similar.

EXAMPLE III

Hoeganaes core uncoated was treated with CERELUBE S-363 TM as in Example I at 0.01 percent and 0.02 percent. Conductivity was measured at 10 volts as in Example I and ranged from $1.5\times10^{-8}$ to $2.5\times10^{-8}$. Toner B-5476 was added at 3 percent by weight. After 15 minutes agitation in a paint shaker, tribo and conductivity were measured at 10 volts.

| CERELUBE S-363 TM Percent | Tribo Microcoulombs/ gram | Conductivity Ohms/cm |
|---|---|---|
| 0 | −14.6 | $7.6\times10^{-12}$ |
| 0.01 | −27.2 | $3.2\times10^{-10}$ |
| 0.02 | −19.7 | $1.0\times10^{-9}$ |

There can also be prepared by melt blending, followed by mechanical attrition, a toner composition comprised of 80 percent by weight of a styrene butadiene resin with 91 percent by weight of styrene and 9 percent by weight of butadiene, 3 percent by weight of REGAL ® 330 carbon black, 16 percent by weight of MAPICO BLACK ®, and 1 percent by weight of the charge enhancing additive distearyl dimethyl ammonium methyl sulfate. Subsequently, there was prepared a developer composition by admixing the aforementioned formulated toner composition at a 4.5 percent toner concentration, that is 4.5 parts by weight of toner per 100 parts by weight of carrier, which carrier was comprised of a steel core with a coating thereover of a vinyl chloride trichlorofluoroethylene copolymer with carbon black particles dispersed therein, and the wax of Example I on the surface of the carrier coating. The toner can be micronized and classified to provide toner particles with an average particle diameter of from about 10 to about 20 microns.

EXAMPLE IV

A toner and developer were prepared by repeating the above processes, reference Example II, and wherein the Hoeganaes core was coated with 0.02 percent and 0.04 percent of zinc stearate, CERELUBE S-363 TM and UNILIN 700 ® as in Example I. The carrier was then blended with toner B-5476 (68 percent VP-75Q, 23 percent S-103C, 8 percent BP1300 CB, 0.3 percent AEROSIL R-972 ® on surface) at 3 percent w/w and tested for tribo and conductivity after paint shaking for 30 minutes with the following results:

| Additive | Percent | Tribo Microcoulombs/ gram | Conductivity Ohms/cm |
|---|---|---|---|
| Zinc Stearate | 0.02 | −9.8 | $1.7\times10^{-8}$ |
| Zinc Stearate | 0.04 | −7.4 | $2.3\times10^{-8}$ |
| CERELUBE S-363 TM | 0.02 | −22.5 | $2.5\times10^{-8}$ |
| CERELUBE S-363 TM | 0.04 | −13.4 | $7.2\times10^{-8}$ |
| UNILIN 700 ® | 0.02 | −23.2 | $8.5\times10^{-9}$ |
| UNILIN 700 ® | 0.04 | −22.6 | $3.5\times10^{-8}$ |

The CERELUBE S-363 TM and the UNILIN 700 ® were superior in tribo than the zinc stearate.

Other modifications of the present invention may occur to those skilled in the art subsequent to a review of the present application. The aforementioned modifications, including equivalents thereof, are intended to be included within the scope of the present invention.

What is claimed is:

1. A developer consisting essentially of a toner composition comprised of resin particles and pigment particles, and carrier particles comprised of a metal core with a coating comprised of a polymeric alcohol wax of the formula $$CH_3(CH_2)_nCH_2OH$$

wherein n is a number of from about 30 to about 300.

2. A developer composition in accordance with claim 1 wherein n is a number of from about 30 to about 50.

3. A method for obtaining images which comprises generating an electrostatic latent image on a photoconductive imaging member, subsequently affecting development of this image with the toner composition of claim 2, thereafter transferring the image to a permanent substrate, and permanently affixing the image thereto wherein filming of the imaging member is substantially avoided or minimized.

4. A method of imaging in accordance with claim 3 wherein a blade means is selected for accomplishing cleaning of the photoresponsive imaging member.

5. A developer composition in accordance with claim 1 wherein the polymeric alcohol wax has a number average molecular weight of from about 475 to about 1,400.

6. A developer composition in accordance with claim 1 wherein said metal core is comprised of steel or a ferrite.

7. A developer composition in accordance with claim 1 wherein the resin particles are selected from the group consisting of polyesters, styrene butadiene copolymers, styrene acrylate copolymers, and styrene methacrylate copolymers.

8. A developer composition in accordance with claim 7 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

9. A developer composition in accordance with claim 1 wherein the pigment particles are carbon black or magnetite.

10. A developer composition in accordance with claim 1 wherein the pigment particles are selected from the group consisting of magenta, cyan, yellow, and mixtures thereof.

11. A developer composition in accordance with claim 1 containing therein a charge enhancing additive.

12. A developer composition in accordance with claim 11 wherein the charge enhancing additive is selected from the group consisting of distearyl dimethyl ammonium methyl sulfate, cetyl pyridinium halides, stearyl phenethyl dimethyl ammonium tosylate, ammonium bis(1-(3,5-dinitro-2-hydroxyphenyl)azo-3-(N-phenylcarbamyl)-2-napthalenolate) chromate, or tris 3,5,ditertiary butyl salicyclic acid aluminum complex.

13. A developer composition in accordance with claim 1 wherein said metal core contains thereover a polymeric coating.

14. A developer composition in accordance with claim 13 wherein the carrier particles are comprised of a steel or a ferrite core with a coating thereover selected from the group consisting of polychlorotrifluoroethylene-co-vinylchloride copolymer, a polyvinylidene fluoropolymer, or a terpolymer of styrene, methacrylate, and an organo silane, fluorinated ethylene-propylene copolymers, and polytetrafluoroethylene.

15. A developer composition in accordance with claim 13 wherein there is present in the carrier polymer coating a polymeric alcohol wax with a number average molecular weight of from about 475 to about 1,400, or a low molecular weight wax.

16. A method for obtaining images which comprises generating an electrostatic latent image on a photoconductive imaging member, subsequently affecting development of this image with the toner composition of claim 1, thereafter transferring the image to a permanent substrate, and optionally permanently affixing the image thereto.

17. A developer composition consisting essentially of a toner composition consisting essentially of resin particles and pigment particles, and carrier particles consisting essentially of a metal core with a polymeric coating thereover, and on said polymeric coating a second coating of a polymeric alcohol of the formula $$CH_3(CH_2)_nCH_2OH$$

wherein n is a number of from about 30 to about 300.

18. A process for increasing the conductivity of a developer containing metal core carrier particles consisting essentially of adding to said carrier particles a polymeric alcohol of the formula $$CH_3(CH_2)_nCH_2OH$$

wherein n is a number of from about 30 to about 300.

19. A process in accordance with claim 18 wherein the conductivity is from about $8.8\times10^{-10}$ to about $3.1\times10^{-9}$ ohms/cm.

20. A process in accordance with claim 19 wherein the triboelectric charge on the toner is 28.7 at $8.8\times10^{-10}$ ohms/cm and $-24.6$ at $3.1\times10^{-9}$ ohms/cm.

* * * * *